US007101005B2

(12) United States Patent
Buonerba et al.

(10) Patent No.: US 7,101,005 B2
(45) Date of Patent: Sep. 5, 2006

(54) APPARATUS FOR ADJUSTING PRINTHEAD-TO-MEDIA SPACING IN A PRINTER

(75) Inventors: Kale Mark Buonerba, Singapore (SG); Wai Yuen Ho, Singapore (SG); Raghuveer Mudambi Srinivasan, Singapore (SG); Mohamed Mydeen Abusalih, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 218 days.

(21) Appl. No.: 10/861,715

(22) Filed: Jun. 3, 2004

(65) Prior Publication Data

US 2005/0270316 A1 Dec. 8, 2005

(51) Int. Cl.
*B41J 25/308* (2006.01)

(52) U.S. Cl. ..... 347/8; 400/59; 400/60

(58) Field of Classification Search ..... 347/8, 347/37–39; 400/59, 60
See application file for complete search history.

(56) References Cited

U.S. PATENT DOCUMENTS 6,616,354 B1 * 9/2003 O'Hara et al. ..... 400/56
6,874,956 B1 * 4/2005 Kelley et al. ..... 400/59
2004/0056911 A1 * 3/2004 Fairchild et al. ..... 347/8

* cited by examiner

*Primary Examiner*—K. Feggins
*Assistant Examiner*—Jason Uhlenhake

(57) ABSTRACT

An apparatus is provided for adjusting the printhead-to-media spacing in a printer having a printhead carrying carriage, which is rockable relative to an elongate carriage rod in the printer to effect a change in such spacing. The apparatus comprises an anti-rotation rail having a primary axis, the anti-rotation rail configured to have the carriage mounted thereon to be rotatable about the primary axis. A carriage guiding block is configured to be mountable on the carriage rod and configured to have the printhead carrying carriage mounted thereon. An actuator is mounted on the carriage guiding block, the actuator movable between a spacing position in which the actuator is arranged to provide a first predetermined separation between the carriage guiding block and the printhead carrying carriage, to provide a first printhead-to-media spacing value, and a retracted position in which the actuator is arranged to provide a second separation between the carriage guiding block and the printhead carrying carriage, to provide a second printhead-to-media spacing value.

15 Claims, 4 Drawing Sheets

APPARATUS FOR ADJUSTING PRINTHEAD-TO-MEDIA SPACING IN A PRINTER

FIELD OF THE INVENTION

The present invention relates to printers. In particular the present invention relates to an apparatus for adjusting the printhead-to-media spacing within a printer to allow for printing on thick media.

BACKGROUND OF THE INVENTION

Inkjet printers operate by expelling droplets of ink onto the media from the printhead, which is the part of the printer that actually prints on a medium, and which generally has a two dimensional array of very small nozzles substantially parallel to the media. The printhead generally does not extend across the width of the printer; instead the printhead is generally mounted on a carriage, which slides sideways across the printer on a carriage rod and an anti-rotation rail (which prevents rotation of the carriage about the carriage rod) that extend across the width of the printer. Therefore, the printhead can print to the width of the media. The media is generally advanced perpendicularly to the dimension in which the printhead carrying carriage slides (i.e. advanced along the length of the media) so that substantially the whole of the media can be printed to.

When the printhead is printing to the media, the further the droplets expelled from the printhead must travel, the lower the resolution achieved in the resulting printout due to lateral movement of the droplets between the printhead and the media. However, if the printhead is brought too close to the media, any warping of the media when the droplets land and temporarily dampen the media could cause the media to come into contact with the printhead, which can lead to smudging of the printed media or even clogging of the printhead.

In order to optimise the so-called printhead-to-media spacing, the printhead must be sufficiently close to the medium that it will print to that medium without loss of resolution, and sufficiently far away from the media to avoid the media warping and touching the printhead. Therefore, there is generally an optimal printhead-to-media spacing for a printhead.

In a conventional inkjet printer, the printhead-to-media spacing is generally set so that the printing is optimised for plain paper as the medium to be printed on, as this is the most often used medium. However, if an envelope, or cardboard, is to be printed on, the extra thickness of the medium will make the printhead-to-media spacing too small, leading to problems outlined above. Additionally, if the printhead-to-media spacing is optimised for envelopes, cardboard or other such thick media then, when printing on thin media such as paper, the printhead-to-media spacing will be too large, leading to other associated problems mentioned above.

SUMMARY OF THE INVENTION

Briefly, the invention provides an apparatus for adjusting the printhead-to-media spacing in a printer having a printhead carrying carriage, which is rockable relative to an elongate carriage rod in the printer to effect a change in such spacing. The apparatus includes an anti-rotation rail having a primary axis. The anti-rotation rail is configured to have the printhead carrying carriage mounted thereon to be rotatable about the primary axis. A carriage guiding block is provided, configured to be mountable on the carriage rod and configured to have the printhead carrying carriage mounted thereon. An actuator is also provided, mounted on the carriage guiding block. The actuator is movable between a spacing position in which the actuator is arranged to provide a first predetermined separation between the carriage guiding block and the printhead carrying carriage, to provide a first printhead-to-media spacing value, and a retracted position in which the actuator is arranged to provide a second separation between the carriage guiding block and the carriage, to provide a second printhead-to-media spacing value.

Other aspects and advantages of the present invention will become apparent from the following detailed description, taken in conjunction with the accompanying drawings, illustrating by way of example the principles of the invention.

BRIEF DESCRIPTION OF THE DRAWINGS

Embodiments of the invention will now be described, purely by way of example, with reference to the accompanying drawings, in which.

DETAILED DESCRIPTION OF EMBODIMENTS OF THE INVENTION

Figure 1:
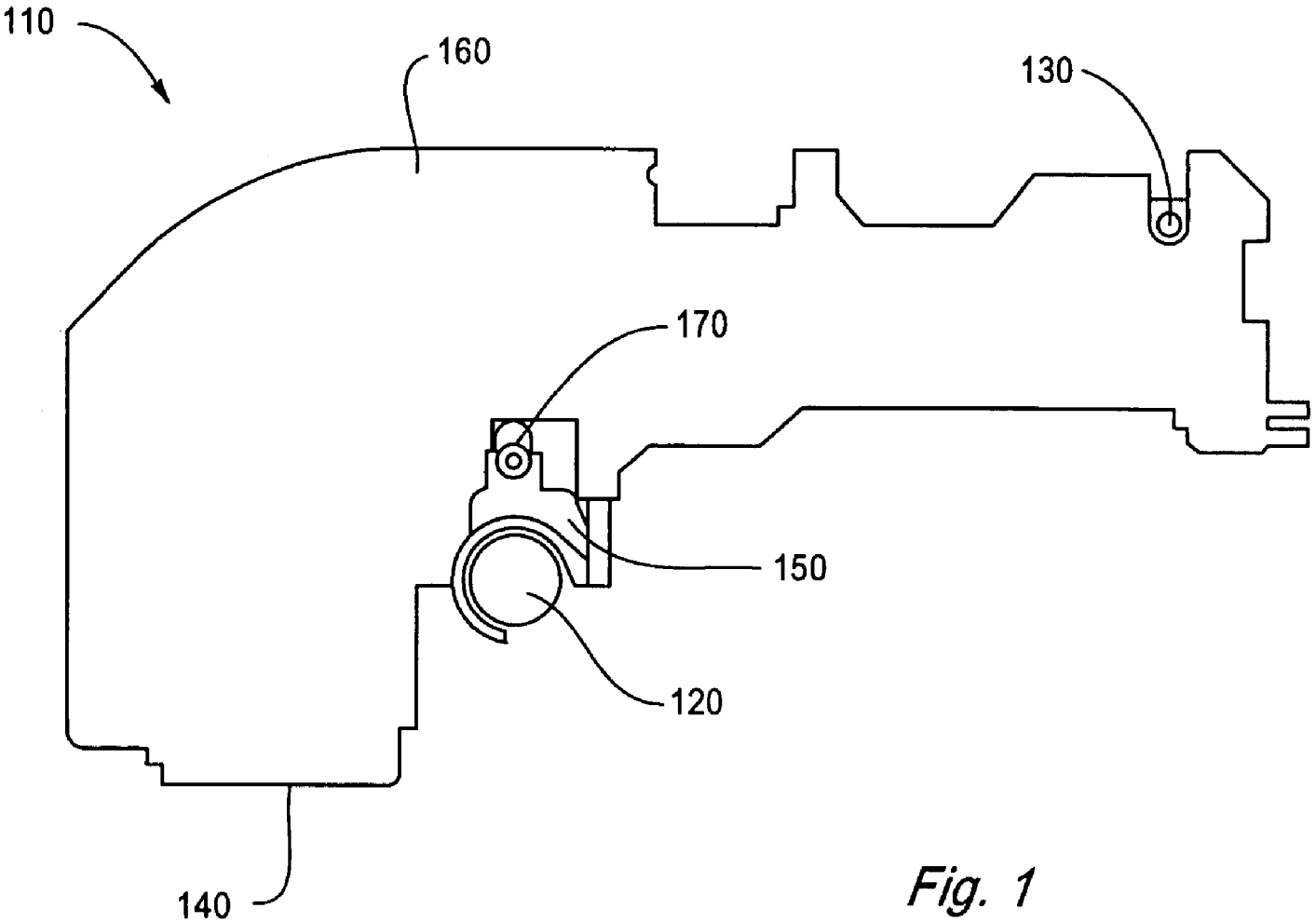
FIG. 1 shows an apparatus showing embodiments of the invention.

An embodiment of the invention as shown in FIG. 1 provides an apparatus for adjusting the printhead-to-media spacing in a printer having a printhead carrying carriage 160, which is rockable relative to an elongate carriage rod 120 in the printer to effect a change in such spacing. The apparatus includes an anti-rotation rail 130 having a primary axis. The anti-rotation rail 130 is configured to have the printhead carrying carriage 160 mounted thereon to be rotatable about the primary axis. A carriage guiding block 150 is provided, configured to be mountable on the carriage rod 120 and configured to have the printhead carrying carriage 160 mounted thereon. An actuator 170 is also provided, mounted on the carriage guiding block 150. The actuator 170 is movable between a spacing position in which the actuator 170 is arranged to provide a first predetermined separation between the carriage guiding block 150 and the printhead carrying carriage 160, to provide a first printhead-to-media spacing value, and a retracted position in which the actuator 170 is arranged to provide a second separation between the carriage guiding block 150 and the printhead carrying carriage 160, to provide a second printhead-to-media spacing value.

Referring again to FIG. 1, another embodiment of the invention provides an apparatus for adjusting the printhead-to-media spacing in a printer. The apparatus includes an elongate carriage rod 120. An elongate anti-rotation rail 130 is also provided. A carriage unit 110 is also provided. The carriage unit 110 includes a carriage guiding block 150, mounted on the carriage rod 120. A printhead carrying carriage 160 is also included, which is rockably mounted on the carriage guiding block 150 and rotatably mounted on the anti-rotation rail 130. The carriage unit 110 also includes an actuator 170, which is moveable between a spacing position, in which the actuator 170 provides a first separation between the carriage guiding block 150 and the printhead carrying carriage 160, to provide a first printhead-to-media spacing value, and a retracted position in which the actuator 170 provides a second separation between the carriage guiding block 150 and the printhead carrying carriage 160, to provide a second printhead-to-media spacing value.

Again referring to FIG. 1, another embodiment of the invention provides an apparatus for adjusting the printhead-to-media spacing in a printer. The apparatus has an elongate carriage rod 120 and a carriage unit 110. The carriage unit 110 includes a printhead carrying carriage 160, which is coupled to the carriage rod 120 so as to allow variable relative separations. A carriage guiding block 150 is also included, which is mounted on the carriage rod 120. The printhead carrying carriage 160 is coupled to the carriage rod 120 by the carriage guiding block 150, and the printhead carrying carriage 160 is rockably mounted on the carriage guiding block 150. An actuator 170 is also provided, which acts between the printhead carrying carriage 160 and carriage guiding block 150. The actuator 170 is movable between a spacing position, in which the actuator 170 provides a first separation between the carriage rod 120 and the printhead carrying carriage 160 to provide a first printhead-to-media spacing value, and a retracted position in which the actuator 170 provides a second separation between the carriage rod 120 and the printhead carrying carriage 160 to provide a second printhead-to-media spacing value.

FIG. 1 shows an embodiment making use of the invention. A carriage unit 110, carriage rod 120 and anti-rotation rail 130 are shown, as described above. The elongate axes of the carriage rod 120 and anti-rotation rail 130 are substantially parallel. A printhead 140 is also shown, mounted on the carriage unit 110, in the present embodiment, on a printhead carrying carriage 160. The carriage unit 110 is mounted on the carriage rod 120 so that it can slide along the carriage rod 120. The carriage unit 110 is also mounted on the anti-rotation rail 130 so that it slides along the rail 130 as it slides along the carriage rod 120. Mounting of the carriage unit 110 on both carriage rod 120 and anti-rotation rail 130 means that the attitude of the carriage unit 110, and therefore the printhead 140, is maintained, as the carriage unit 110 slides along the carriage rod 120.

As shown in FIG. 1, the printhead 140 is mounted on the printhead carrying carriage 160 on the side of the elongate axis of the carriage rod 120 distal to the anti-rotation rail 130. As the actuator 170 is moved from a retracted position to a spacing position, the separation between printhead carrying carriage 160 and carriage rod 120 is increased. As this occurs, the printhead carrying carriage 160 rotates about the anti-rotation rail 130. The printhead 140 moves from a first position with a first printhead-to-media spacing value to a second position with a second printhead-to-media spacing value as the actuator 170 moves from the retracted to the spaced position. As the printhead 140 is mounted below the printhead carrying carriage 160, increasing the separation between the printhead carrying carriage 160 and the carriage guiding block 150 also increases the printhead-to-media spacing value.

In an embodiment, the printhead carrying carriage 160 is arranged such that a printhead 140 carried by the printhead carrying carriage 160 is disposed on a first side of the elongate axis of the carriage rod 120, the first side being the side distal to the anti-rotation rail 130. In this way, where the printhead carrying carriage 160 rotates about the anti-rotation rail 130 when the printhead carrying carriage 160 to carriage rod 120 separation is adjusted, a printhead 140 mounted on the printhead carrying carriage 160 is on the opposite side of the carriage rod 120, when looking along the elongate axis of the rod 120, to the anti-rotation rail 130. Such arrangement makes the radius of the rotation of the printhead 140 about the anti-rotation rail 130 as large as possible.

In many cases, the printhead 140 is a two dimensional array of inkjets, and this two-dimensional array should be kept at substantially the same attitude, (in many cases parallel to the medium to be printed on), due to the optimal distance between each inkjet of the printhead 140 and the medium. The large radius makes the relative difference in radius between the inkjets closest to and furthest away from the carriage rod 120 small. The difference in inkjet to media separation between the different parts of the printhead 140 between different rotations of the printhead carrying carriage 160 is therefore reduced, and the printhead 140 is maintained close to parallel with the medium to be printed on, when in both the first and second positions. This maintenance of the printhead 140 close to parallel with the media reduces adverse effects of one part of the printhead 140 being too close to the medium, while another part of the printhead 140 is simultaneously too far away, during printing.

In the embodiments described herein, the actuator 170 is mounted on the carriage guiding block 150. However, it will be seen that an actuator could be mounted on printhead carrying carriage 160 itself instead of the carriage guiding block and work in the same manner.

Additionally, in the embodiments described herein, the printhead carrying carriage 160 is able to slide along the length of the carriage rod 120. However, the invention could also be applied in a printer in which the printhead carrying carriage did not slide along the carriage rod, and the printhead was available to print to the whole width (and/or length) of a medium placed in the printer without relative transverse movement of the two.

Figure 2A:
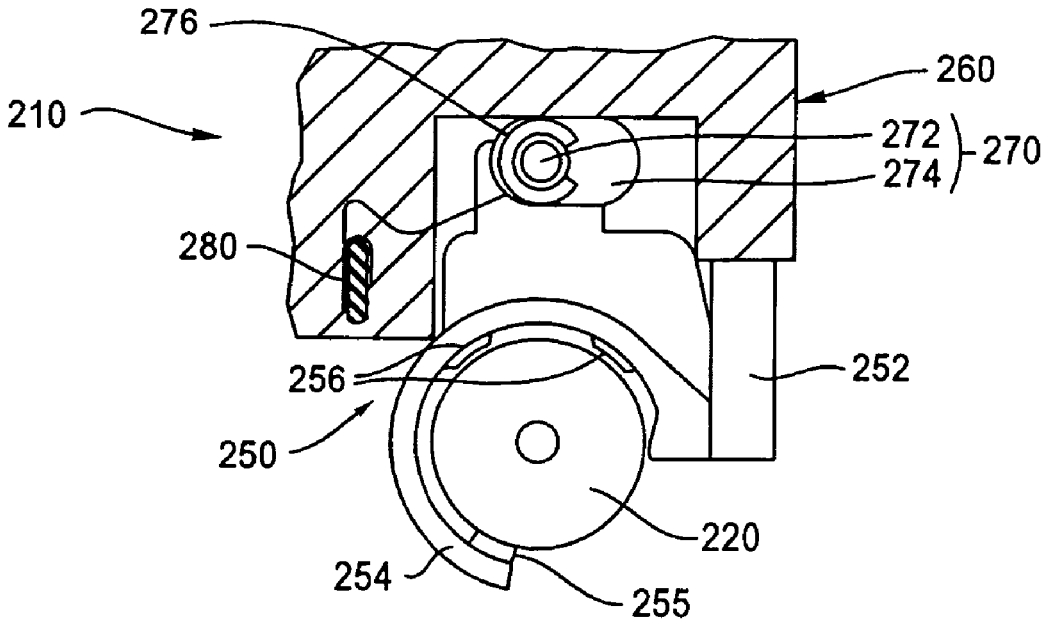
FIG. 2*a* shows a detail of an apparatus of an embodiment of the invention.

FIG. 2*a* shows a detail of a carriage unit 210 of an embodiment of the invention corresponding to that shown in FIG. 1. The carriage unit 210 of an embodiment includes a carriage guiding block 250, which is mounted on a carriage rod 220, a printhead carrying carriage 260, mounted on the carriage guiding block 250 and an actuator 270, which in the present embodiment is mounted on the carriage guiding block 250.

In an embodiment, the actuator 270 includes a cam rod 272 rotatably mounted on the carriage guiding block 250. The cam rod 272 has in the present embodiment, two excentric cams 274 mounted on it, each having a single lobe, or portion of greater radius, which are held against movement along the cam rod 272 by retainers 276. FIG. 2*a* shows the actuator 270 in a retracted position. The lobe of the excentric cam 274 is not abutting the printhead carrying carriage 260, and the printhead carrying carriage 260 abuts the carriage guiding block 250.

Figure 2B:
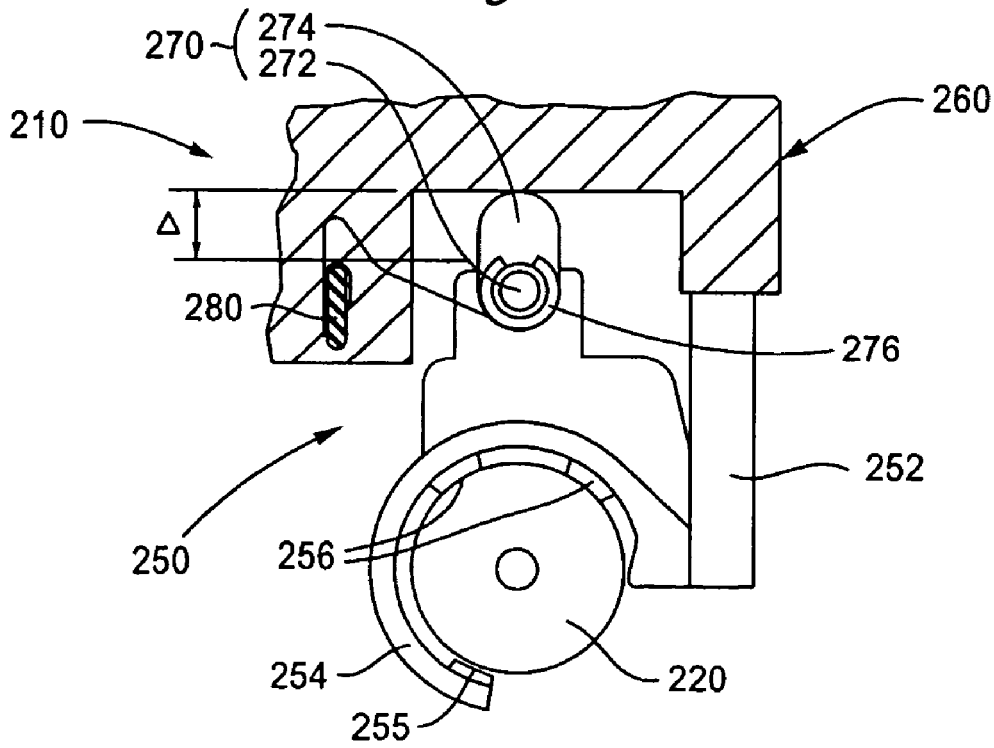
FIG. 2*b* shows a detail of the apparatus shown in FIG. 2*a* in a different configuration, in accordance with an embodiment of the invention.

FIG. 2*b* shows an embodiment corresponding to that of FIG. 2*a* wherein the actuator 270 is shown in a spacing position. In this position, the cam 274 abuts the printhead carrying carriage 260. The cam 274 has pushed the printhead carrying carriage 260 away from the carriage guiding block 250, to cause an increased separation between the printhead carrying carriage 260 and the carriage guiding block 250 and therefore between the printhead carrying carriage 260 and the carriage rod 220. The lobe of the cam 274 abuts the printhead carrying carriage 260 in a detent, which avoids any intermediate position from being selected for the actuator 270 and encourages the printhead carrying carriage 260 to be firmly seated on the cam 274 when the actuator 270 is in the spacing position.

The carriage guiding block 250 also has an enclosing region 254, which encloses the carriage rod 220 sufficiently to prevent the carriage guiding block 250 from being lifted off the carriage rod 220. Part of the enclosing region 254 abuts the carriage rod 220 to support the carriage guiding block 250 on the carriage rod 220, as described below.

Biasing members, in the form of springs 280 are also provided in this embodiment. One end of each spring 280 is mounted to the cam rod 272. The other end of each spring 280 is mounted on the printhead carrying carriage 260. The springs 280 bias the relative separation of the carriage guiding block 250 and printhead carrying carriage 260 to a minimum. When the actuator 270 is in the retracted position, this biasing pulls the carriage guiding block 250 upwards. The enclosing region is slightly non-circular, being stretched in the vertical direction. Therefore, the carriage rod 220 abuts the inside of the enclosing region 254 on a bearing 255 on a lower region of the inside of the enclosing region. The bearing 255 does not extend all the way along the enclosing region 254 along the carriage rod 220, but provides point contact at an end of the carriage guiding block 250. A second bearing, not shown, corresponding in position and function to the bearing 255, is provided at the other end of the carriage block 250. The bearings 255 are simply plastic bushes, designed to allow the carriage guiding block 250 to slide along.

When the actuator 270 is in the retracted position, as shown in FIG. 2*a*, the biasing spring 280 removes the separation between printhead carrying carriage 260 and carriage guiding block 250, so that the two are abutting. When the actuator 270 is turned to the spacing position, as shown in FIG. 2*b*, the lobe of the cam 274 pushes the printhead carrying carriage 260 away from the carriage guiding block 250 against the biasing of the spring 280, giving a separation of Δ between the printhead carrying carriage 260 and carriage guiding block 250. As rotation of the actuator 270 is started, the carriage guiding block 250 is pushed downwards to overcome the small amount of play between the carriage rod 220 and enclosing region 254 of the carriage guiding block 250, caused by the slight vertical stretching of the enclosing region 254. The carriage rod 220 then abuts further bearings 256, on upper regions of the inside of the enclosing region 254.

The bearings 256 are point bearings of the same type as bearing 255, and a corresponding pair of bearings is also provided at the other end of the carriage guiding block 250. Once the carriage guiding block 250 abuts the further bearings 256, further rotation of the actuator 270 causes separation of the carriage guiding block 250 and printhead carrying carriage 260. Once the actuator 270 is in the spacing position, the carriage guiding block 250 and printhead carrying carriage 260 are separated and the spring 280 is deformed by an amount Δ, as one end is connected to the printhead carrying carriage 260, and the other abuts the cam 272. In the present embodiment, the difference in radius of the lobe of the cam 274 to that of the rest of the cam 274 corresponds to the difference between the spacing position and retracted position.

Figure 3A:
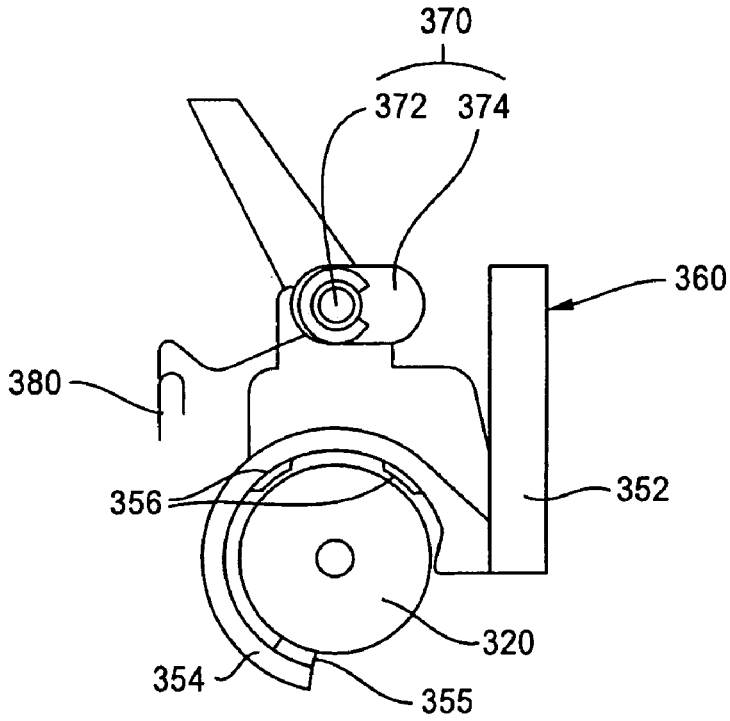
FIG. 3*a* shows part of the detail shown in FIGS. 2*a* and 2*b*, in accordance with an embodiment of the invention.
Figure 3B:
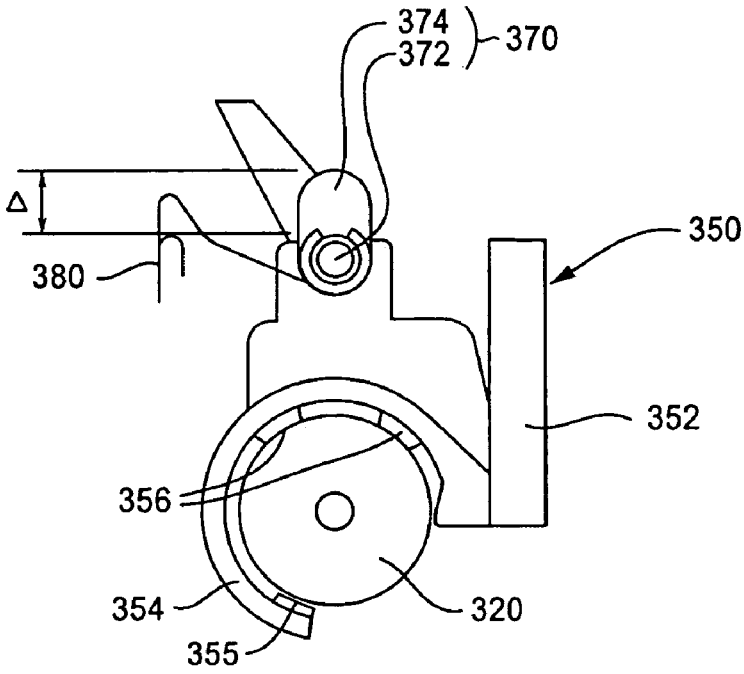
FIG. 3*b* shows the part of the detail shown in FIG. 3*a* in a different configuration, in accordance with an embodiment of the invention.

FIGS. 3*a* and 3*b* show one end of a carriage rod 320 and a carriage guiding block 350 of an embodiment corresponding to that shown in FIGS. 2*a* and 2*b*, with the carriage removed. The carriage guiding block 350 has an upstanding elongate locating bar 352 at each end of the carriage guiding block 350. The locating bar 352 has a main axis along its elongate length and is configured to engage a correspondingly dimensioned orifice in the carriage with the same cross section as the locating bar 352. The locating bar 352 has the same cross section throughout its length, which allows it to be inserted into the corresponding orifice in the carriage by varying amounts.

When the locating bar 352 is inserted into the orifice, lateral movement between the carriage and carriage guiding block 350 (movement of the printhead carrying carriage relative to the locating bar 352 in any direction other than along the elongate axis) is substantially prevented. The only movement between the carriage guiding block 350 and printhead carrying carriage is therefore along the elongate axis of the locating bar 352. Therefore, when the printhead carrying carriage is mounted on the carriage guiding block 350, the relative separation of the carriage guiding block 350 and printhead carrying carriage can be altered by rotating cam rod 372 and causing the cam 374 to rotate as shown in FIGS. 3*a* and 3*b*.

However, the printhead carrying carriage and carriage guiding block 350 are restrained from rotating relative to each other, and are restrained from moving relative to one another along the axis of the carriage rod 320. When the printhead carrying carriage is mounted on the anti-rotation rail 330, the carriage guiding block 350 cannot rotate about the printhead carrying carriage. Therefore, the carriage guiding block 350 cannot rotate about the carriage rod 320, and the carriage unit 310 is kept from rotating. Additionally, the carriage guiding block 350 and the printhead carrying carriage will move together along the carriage rod 320.

Figure 4:
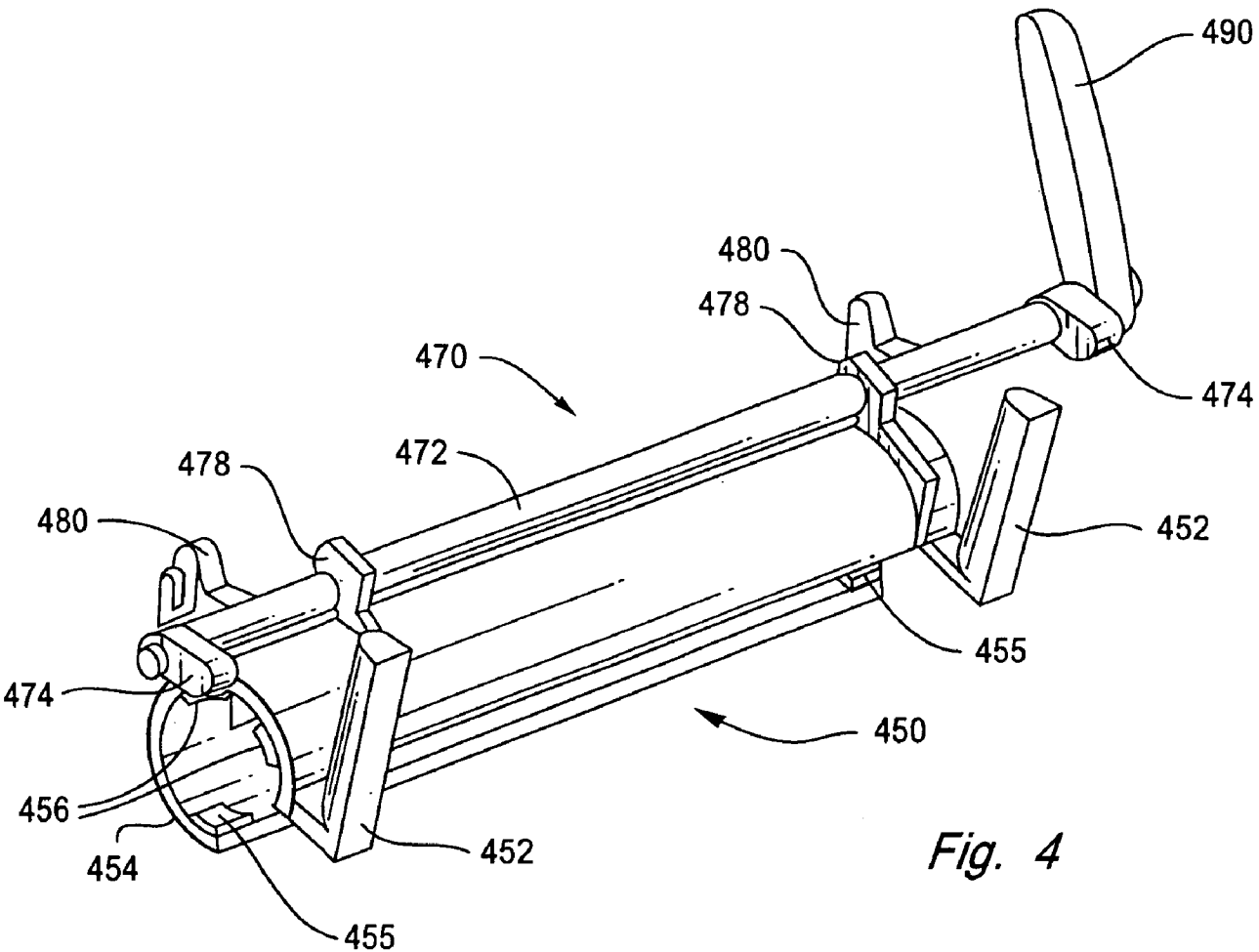
FIG. 4 shows a part of the apparatus shown in FIGS. 3*a* and 3*b* from a different angle, in accordance with an embodiment of the invention.

FIG. 4 shows a carriage guiding block 450 and actuator 470 of an embodiment, corresponding to those described in relation to FIGS. 3*a* and 3*b* above, from a perspective angle. An elongate enclosing region 454 extends for substantially the whole length of the carriage guiding block 450. The carriage guiding block 450 has two locating bars 452. One locating bar 452 is positioned at either end of the carriage guiding block 450, along the elongate direction of the enclosing region 454. Both bars 452 function as described above.

A cam rod 472 extends in a direction substantially parallel to the elongate direction of the enclosing region 454 and extends beyond the ends of the carriage guiding block 450. As can be seen in FIG. 4, a cam 474 is mounted at substantially each end of the cam rod 472. The cam rod 472 is mounted to the carriage guiding block by two retaining loops 478, one in each end region of the carriage guiding block 450. The retaining loops 478 retain the cam rod 472 against sliding through the retaining loops 478 and therefore retain the cam rod 472 against sliding axially relative to the carriage guiding block 450.

Two springs 480 are provided, as described in relation to FIGS. 2*a* and 2*b*. The springs 480 are mounted at substantially the ends of the carriage guiding block 450, between the cams 474 and the retaining loops 478. These springs 480 bias the carriage guiding block 450 towards the carriage as described above when the printhead carrying carriage is mounted on the carriage guiding block.

A handle 490 is provided on one end of the cam rod 472. The handle 490 allows manual rotation of the cam rod 472, leading to manual engagement of the cams 474 to move the actuator 470 between the spacing and retracted positions, thereby to change the printhead-to-media spacing from a first to a second value, as described above.

The apparatus of the present invention has been described above purely by way of example, and modifications will present themselves to the person skilled in the art and are within the scope and spirit of the invention, which is not limited to the above example, but also resides in any individual features and any combinations thereof.

What is claimed is:

1. An apparatus for adjusting the printhead-to-media spacing in a printer having a printhead carrying carriage, which is rockable relative to an elongate carriage rod in the printer to effect a change in such spacing, the apparatus comprising:

an anti-rotation rail having a primary axis, the anti-rotation rail configured to have the carriage mounted thereon to be rotatable about the primary axis;

a carriage guiding block configured to be mountable on the carriage rod and configured to have the printhead carrying carriage mounted thereon; and an actuator mounted on the carriage guiding block, the actuator movable between a spacing position in which the actuator is arranged to provide a first predetermined separation between the carriage guiding block and the printhead carrying carriage, to provide a first printhead-to-media spacing value, and a retracted position in which the actuator is arranged to provide a second separation between the carriage guiding block and the printhead carrying carriage, to provide a second printhead-to-media spacing value.

2. An apparatus according to claim 1, wherein the actuator comprises a cam rod and a cam mounted thereon, the cam having a lobe, the cam rod being mounted on the carriage guiding block, and wherein rotation of the cam rod causes the cam to rotate between a first position in which the actuator is in the spacing position and the lobe abuts the printhead carrying carriage, and a second position in which the actuator is in the retracted position and the lobe does not abut the printhead carrying carriage.

3. An apparatus according to claim 1, further comprising a biasing member configured to bias the printhead carrying carriage towards the carriage guiding block.

4. A printer comprising a printhead and an apparatus according to claim 1, wherein the apparatus comprises: an anti-rotation rail having a primary axis, the anti-rotation rail configured to have the carriage mounted thereon to be rotatable about the primary axis;

A carriage guiding block configured to be mountable on the carriage rod and configured to have the printhead carrying carriage mounted thereon; and An actuator mounted on the carriage guiding block, the actuator movable between a spacing position in which the actuator is arranged to provide a first predetermined separation between the carriage guiding block and the print head carrying carriage, to provide a first printhead-to-media spacing value, and a retracted position in which the actuator is arranged to provide a second separation between the carriage guiding block and the printhead carrying carriage, to provide a second printhead-to-media spacing value.

5. An apparatus for adjusting the printhead-to-media spacing in a printer, the apparatus comprising:

an elongate carriage rod;

an elongate anti-rotation rail; and a carriage unit, the carriage unit comprising:

a carriage guiding block, mounted on the carriage rod;

a printhead carrying carriage, rockably mounted on the carriage guiding block and rotatably mounted on the anti-rotation rail; and an actuator moveable between a spacing position, in which the actuator provides a first separation between the carriage guiding block and the printhead carrying carriage, to provide a first printhead-to-media spacing value, and a retracted position in which the actuator provides a second separation between the carriage guiding block and the printhead carrying carriage, to provide a second printhead-to-media spacing value.

6. An apparatus according to claim 5, wherein the actuator comprises a cam rod and a cam mounted thereon, the cam having a lobe, the cam rod being mounted on the carriage guiding block, and wherein rotation of the cam rod causes the cam to rotate between a first position in which the actuator is in the spacing position and the lobe abuts the printhead carrying carriage, and a second position in which the actuator is in the retracted position and the lobe does not abut the printhead carrying carriage.

7. An apparatus according to claim 5, wherein the anti-rotation rail is mounted parallel to and laterally spaced from the carriage rod on a first side thereof and wherein a region of the printhead carrying carriage for receiving a printhead is disposed on a second side of the carriage rod, the second side being the side distal to the anti-rotation rail.

8. An apparatus according to claim 5, further comprising a biasing member to bias the printhead carrying carriage to the carriage guiding block.

9. An apparatus for adjusting the printhead-to-media spacing in a printer, the apparatus comprising:

an elongate carriage rod; and a carriage unit, the carriage unit comprising:

a printhead carrying carriage, coupled to the carriage rod so as to allow variable relative separations;

a carriage guiding block mounted on the carriage rod, wherein the printhead carrying carriage is coupled to the carriage rod by the carriage guiding block, the carriage being rockably mounted on the carriage guiding block; and an actuator acting between the printhead carrying carriage and carriage guiding block, moveable between a spacing position, in which the actuator provides a first separation between the carriage rod and the printhead carrying carriage to provide a first printhead-to-media spacing value, and a retracted position in which the actuator provides a second separation between the carriage rod and the printhead carrying carriage to provide a second printhead-to-media spacing value.

10. An apparatus according to claim 9, further comprising an elongate anti-rotation rail mounted parallel to and laterally spaced from the carriage rod on a first side of the elongate dimension of the carriage rod, the printhead carrying carriage being rotatably mounted on the anti-rotation rail.

11. An apparatus according to claim 10, wherein the printhead carrying carriage is arranged such that a region of the printhead carrying carriage is disposed on a second side of the carriage for receiving a printhead rod, the second side being the side distal to the anti-rotation rail.

12. An apparatus according to claim 9, wherein the actuator comprises a cam rod and a cam mounted thereon, the cam having a lobe, the cam rod being mounted on the printhead carrying carriage, and wherein rotation of the cam rod causes the cam to rotate between a first position in which the actuator is in the spacing position and the lobe abuts the carriage guiding block and a second position, in which the actuator is in the retracted position and the lobe does not abut the carriage guiding block.

13. An apparatus according to claim 9, further comprising a biasing member to bias the carriage towards the carriage guiding block.

14. An apparatus according to claim 9, wherein the actuator is manually rotatable.

15. A printer comprising:

an elongate carriage rod;

a printhead carrying carriage, which is rockable relative to the elongate carriage rod to effect a change in spacing between carriage rod and printhead carrying carriage;

an anti-rotation rail having a primary axis, the anti-rotation rail having the printhead carrying carriage mounted thereon so as to be rotatable about the primary axis;

a carriage guiding block mounted on the carriage rod and having the printhead carrying carriage mounted thereon;

a biasing member mounted between the carriage guiding block and the printhead carrying carriage, to bias the carriage towards the carriage guiding block; and an actuator mounted on the carriage guiding block, the actuator comprising a cam rod and an excentric cam having a lobe, the cam rod being mounted on the carriage guiding block, and wherein rotation of the cam rod causes the cam to rotate between:

(a) a first position in which the actuator is in a spacing position, in which the lobe abuts the printhead carrying carriage, to provide a first predetermined separation of guiding block and printhead carrying carriage, to provide a first printhead-to-media spacing value, and (b) a second position in which the actuator is in a retracted position and the lobe does not abut the printhead carrying carriage, to provide a second separation between the carriage guiding block and the printhead carrying carriage, to provide a second printhead-to-media spacing value.

* * * * *